US006095393A

United States Patent [19]

Smolinski

[11] Patent Number: 6,095,393

[45] Date of Patent: Aug. 1, 2000

[54] FASTENER-DRIVING TOOL HAVING MAGAZINE MOUNTED TO TOOL HANDLE BY MORTISE AND TENON MOUNTING

[75] Inventor: Darek Smolinski, Chicago, Ill.

[73] Assignee: Illinois Tool Works Inc., Glenview, Ill.

[21] Appl. No.: 09/187,558

[22] Filed: Nov. 6, 1998

[51] Int. Cl.[7] ..... B25C 1/04

[52] U.S. Cl. ..... 227/120; 227/136

[58] Field of Search ..... 227/120, 135, 227/136, 137, 156

[56] References Cited

U.S. PATENT DOCUMENTS

| | | | |
|---|---|---|---|
| 3,330,462 | 7/1967 | Colechia et al. | 227/136 |
| 4,319,705 | 3/1982 | Geist et al. | 227/120 |
| 4,585,154 | 4/1986 | Fealey et al. | 227/120 |
| 4,600,135 | 7/1986 | Mukoyama | 227/120 |
| 4,942,996 | 7/1990 | Wolfberg et al. | 227/136 |
| 5,522,533 | 6/1996 | Mukoyama et al. | 227/136 |
| 5,683,024 | 11/1997 | Eminger et al. | 227/137 |
| 5,697,541 | 12/1997 | Burke et al. | 227/120 |
| 5,799,856 | 9/1998 | Mukoyama et al. | 227/136 |

*Primary Examiner*—Scott A. Smith

*Attorney, Agent, or Firm*—Mark W. Croll; Thomas W. Buckman; John P. O'Brien

[57] ABSTRACT

In a fastener-driving tool comprising a housing structure with a handle and a nosepiece and a magazine with a main body and a hinged cover, the main body is mounted to the handle by a mortise and tenon mounting, which comprises a structure integral with the main body and defining a mortise and a structure integral with the handle and defining a tenon. The mortise and the tenon are tapered complementarily so that the tenon can wedge into the mortise. The mortise has a widened region and the tenon has a widened portion fitting into the widened region so as to prevent the tenon from pulling from the mortise in a direction normal to the handle.

9 Claims, 1 Drawing Sheet

FASTENER-DRIVING TOOL HAVING MAGAZINE MOUNTED TO TOOL HANDLE BY MORTISE AND TENON MOUNTING

TECHNICAL FIELD OF THE INVENTION

This invention pertains to improvements in a fastener-driving tool of a type illustrated and described in U.S. Pat. No. 4,942,996 to Wolfberg et al., wherein a magazine is adapted to store a strip of collated fasteners, such as a coiled strip of collated nails.

BACKGROUND OF THE INVENTION

As illustrated and described in U.S. Pat. No. 4,942,996, supra, a pneumatically powered, fastener-driving tool comprises a housing structure having a handle and having a nosepiece, through which fasteners are driven individually and successively, and a magazine mounted to the handle and to the nosepiece and adapted to store a strip of collated fasteners, such as a coiled strip of collated nails.

As illustrated and described therein, the magazine includes a main body defining what are described therein as fixed wall portions and a cover defining what are described therein as movable wall portions. The main body is mounted to the nosepiece, to which the cover is hinged, and the main body is mounted to the handle by two bolts, which bolt the main body to a bracket projecting from the handle.

SUMMARY OF THE INVENTION

This invention provides improvements in a fastener-driving tool, which may be pneumatically powered or combustion-powered, which comprises a housing structure having a handle and having a nosepiece, and which comprises a magazine adapted to store a strip of collated fasteners, as exemplified by but not limited to a coiled strip of collated nails. As contemplated by this invention, a mortise and tenon mounting is employed to mount the main body to the handle. The mortise and tenon mounting, which may resemble a dovetail joint, does not require any bolts or other fasteners.

Preferably, the mortise and tenon mounting comprises a structure defining a mortise and a structure defining a tenon adapted to fit into the mortise, one such structure being integral with the main body and the other structure being integral with the handle. In a preferred embodiment, the structure defining the mortise is integral with the main body, and the structure defining the tenon is integral with the handle.

In the preferred embodiment, the mortise and the tenon are tapered complementarily so that the tenon is adapted to wedge into the mortise. Thus, the mortise has a comparatively wide end opening toward the nosepiece and a comparatively narrow end opening oppositely, and the tenon has a comparatively wide end fitting into the comparatively wide end of the mortise and a comparatively narrow end fitting into the comparatively narrow end of the mortise. In the preferred embodiment, moreover, the mortise has a widened region and the tenon has a widened portion fitting into the widened region so as to prevent the tenon from pulling from the mortise in a direction normal to the handle.

These and other objects, features, and advantages of this invention are evident from the following description of a preferred embodiment of this invention.

DETAILED DESCRIPTION OF THE PREFERRED EMBODIMENT

Figure 1:
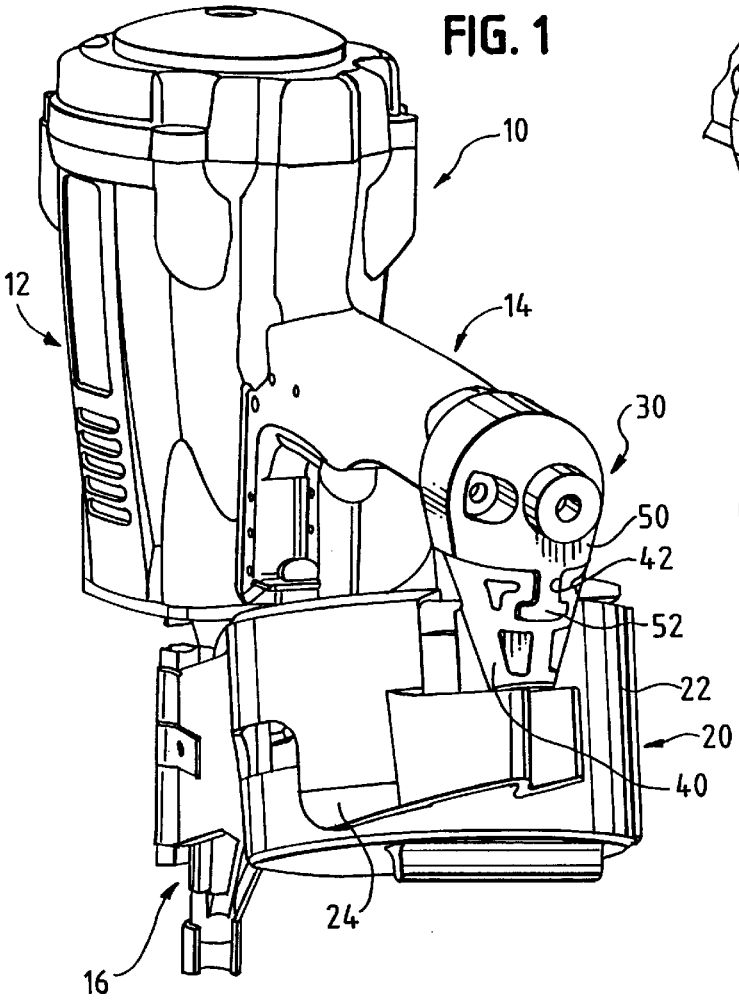
FIG. 1 is a perspective view of a fastener-driving tool constituting a preferred embodiment of this invention.
Figure 3:
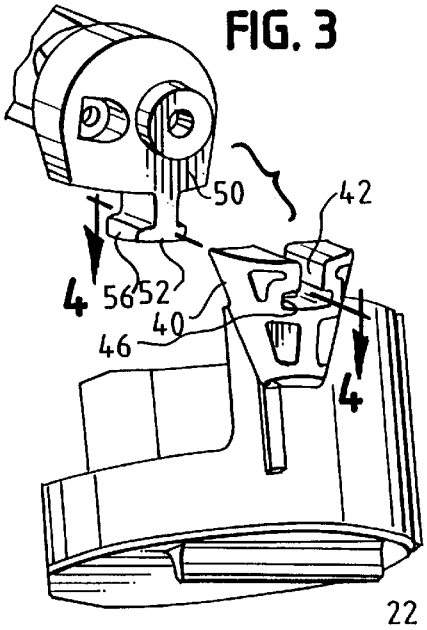
FIG. 3, on the scale of FIG. 1, is an exploded view of a structure defining a mortise and a structure defining a tenon, both from the mortise and tenon mounting.

As illustrated in FIG. 1, a pneumatically powered, fastener-driving tool 10 constitutes a preferred embodiment of this invention. Except as illustrated and described herein, the fastener-driving tool 10 is similar to the fastener-driving tool illustrated and described in U.S. Pat. No. 4,942,996, supra, the disclosure of which is incorporated herein by reference, and to fastener-driving tools available commercially heretofore from ITW Paslode (a unit of Illinois Tool Works Inc.) of Vernon Hills, Ill. under its PASLODE trademark.

The fastener-driving tool 10 is similar thereto in that it comprises a housing structure 12 having a handle 14 and having a nosepiece 16, through which fasteners are driven in a known manner outside the scope of this invention. The fastenerdriving tool 10 is similar thereto in that it comprises a magazine 20, which is adapted to store a strip of collated fasteners, such as a coiled strip of collated nails, and in that the magazine includes a main body 22 defining fixed wall portions and a cover 24 defining movable wall portions. Although the housing structure 12 including the handle 14 may be predominantly made from steel, the main body 22, the cover 24, or both may be predominantly made from steel or from a polymeric material.

The main body 22 is mounted to the nosepiece 16 in a known manner, which is outside the scope of this invention. The cover 24 is hinged to the nosepiece 16 in a known manner, which is outside the scope of this invention, and is latchable to the main body 22 in a known manner, which is outside the scope of this invention. However, the main body 22 is mounted to the handle 14 in a novel manner, which is contemplated by this invention.

As illustrated herein, the main body 22 is mounted to the handle 14 by a mortise and tenon mounting 30, which resembles a dovetail joint. The mortise and tenon mounting 30 comprises a structure 40 defining a mortise 42 and a structure 50 defining a tenon 52, which is adapted to fit into the mortise 42. The structure 40 defining the mortise 42 is mounted integrally on the handle 14 by fasteners 44 (one shown) and the structure 50 defining the tenon 52 is mounted similarly on the main body 22.

Figure 4:
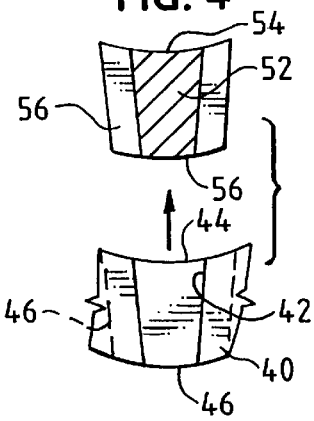
FIG. 4, on the scale of FIG. 2, is a sectional view taken along line 4—4 of FIG. 3, in a direction indicated by arrows.
Figure 2:
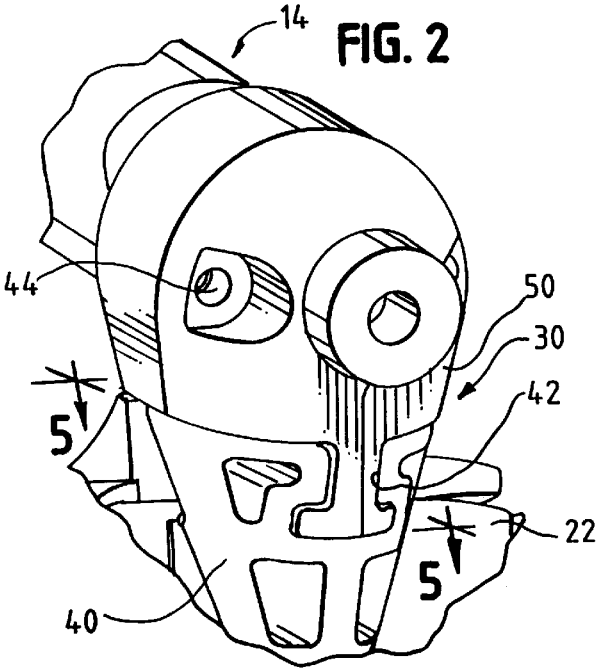
FIG. 2, on a larger scale, is a fragmentary detail taken from FIG. 1 and illustrating a mortise and tenon mounting from the fastener-driving tool.
Figure 5:
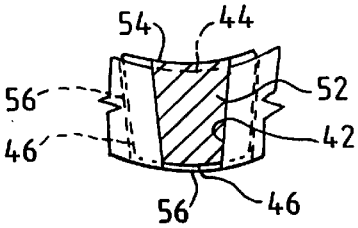
FIG. 5, on the scale of FIG. 2, is a sectional view taken along line 5—5 of FIG. 2, in a direction indicated by arrows.

As illustrated in FIGS. 4 and 5, the mortise 42 and the tenon 52 are tapered complementarily so that the tenon 52 is adapted to wedge into the mortise 42. Thus, the mortise 42 has a comparatively wide end 44 opening toward the nosepiece 16 and a comparatively narrow end 46 opening oppositely. Also, the tenon 52 has a comparatively wide end 54 fitting into the comparatively wide end 44 of the mortise 42 and a comparatively narrow end 56 fitting into the comparatively narrow end 46 of the mortise 42. As illustrated, the mortise 42 is shaped so as to resemble an inverted "T" when viewed along the handle 14, in a direction toward the nosepiece 16, whereby the mortise 42 has a widened region 46. Furthermore, the tenon 52 is shaped similarly when viewed along the handle 14, in a direction toward the nosepiece 16, whereby the tenon 52 has a widened portion 56 fitting into the widened region 46 of the mortise 42 so as to prevent the tenon 52 from pulling from the mortise 42 in a direction normal to the handle 14.

When the fastener-driving tool 10 is assembled, the tenon 52 is wedged into the mortise 42 before the main body 22 is mounted to the nosepiece 16. Because of the mortise and tenon mounting 40, the fastener-driving tool 10 is easier to assemble, as compared to known fastener-driving tools, such as the fastener-driving tool illustrated and described in U.S. Pat. No. 4,942,996, supra.

Various modifications may be optionally made in the preferred embodiment without departing from the scope and spirit of this invention.

I claim:

1. A fastener-driving tool comprising a housing structure, which has a handle and a nosepiece, and a magazine, which is adapted to store a strip of collated fasteners, the magazine including a main body joined to the nosepiece and to the handle and a cover hinged to the nosepiece and latchable to the main body, the main body being mounted to the handle by a mortise and tenon mounting.

2. The fastener-driving tool of claim 1 wherein the mortise and tenon mounting comprises a structure integral with one of the handle and the main body and defining a mortise and a structure integral with the other thereof and defining a tenon adapted to fit into the mortise.

3. The fastener-driving tool of claim 2 wherein the structure defining the mortise is integral with the main body and wherein the structure defining the tenon is integral with the handle.

4. The fastener-driving tool of claim 3 wherein the mortise has a comparatively wide end opening toward the nosepiece and a comparatively narrow end opening oppositely and wherein the tenon has a comparatively wide end fitting into the comparatively wide end of the mortise and a comparatively narrow end fitting into the comparatively narrow end of the mortise.

5. The fastener-driving tool of claim 3 wherein the mortise has a widened region and wherein the tenon has a widened portion fitting into the widened region so as to prevent the tenon from pulling from the mortise in a direction normal to the handle.

6. The fastener-driving tool of claim 5 wherein the mortise has a comparatively wide end opening toward the nosepiece and a comparatively narrow end opening oppositely and wherein the tenon has a comparatively wide end fitting into the comparatively wide end of the mortise and a comparatively narrow end fitting into the comparatively narrow end of the mortise.

7. The fastener-driving tool of claim 2 wherein the mortise has a comparatively wide end opening toward the nosepiece and a comparatively narrow end opening oppositely and wherein the tenon has a comparatively wide end fitting into the comparatively wide end of the mortise and a comparatively narrow end fitting into the comparatively narrow end of the mortise.

8. The fastener-driving tool of claim 2 wherein the mortise has a widened region and wherein the tenon has a widened portion fitting into the widened region so as to prevent the tenon from pulling from the mortise in a direction normal to the handle.

9. The fastener-driving tool of claim 8 wherein the mortise has a comparatively wide end opening toward the nosepiece and a comparatively narrow end opening oppositely and wherein the tenon has a comparatively wide end fitting into the comparatively wide end of the mortise and a comparatively narrow end fitting into the comparatively narrow end of the mortise.

* * * * *